US006552485B2

(12) United States Patent
Gehring et al.

(10) Patent No.: US 6,552,485 B2
(45) **Date of Patent: *Apr. 22, 2003**

(54) ELECTRON TUBE COMPRISING A SEMICONDUCTOR CATHODE

(75) Inventors: Frederik C. Gehring, Eindhoven (NL); Ron Kroon, Eindhoven (NL); Tom Van Zutphen, Eindhoven (NL)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/338,047

(22) Filed: Jun. 22, 1999

(65) Prior Publication Data

US 2002/0079823 A1 Jun. 27, 2002

(30) Foreign Application Priority Data

Jun. 25, 1998 (EP) ..... 98202113

(51) Int. Cl.[7] ..... H01J 29/46
(52) U.S. Cl. ..... 313/446; 313/414; 313/346 R
(58) Field of Search ..... 313/446, 412, 313/414, 270, 337, 346 R, 346 DC

(56) References Cited

U.S. PATENT DOCUMENTS

| | | | | | |
|---|---|---|---|---|---|
| 3,906,277 | A | * | 9/1975 | Schade | 313/365 |
| 3,983,574 | A | * | 9/1976 | Statz et al. | 257/461 |
| 4,533,852 | A | * | 8/1985 | Frank et al. | 313/346 DC |
| 4,611,146 | A | * | 9/1986 | Morrison | 313/446 |
| 4,736,135 | A | * | 4/1988 | Zwier et al. | 313/546 |
| 4,748,369 | A | * | 5/1988 | Phillips et al. | 313/250 |
| 4,900,982 | A | * | 2/1990 | Kolpin | 313/452 |
| 5,444,328 | A | | 8/1995 | Van Zutphen | 313/446 |
| 5,495,143 | A | * | 2/1996 | Lengyel et al. | 313/574 |
| 5,962,977 | A | * | 10/1999 | Matsumoto et al. | 313/633 |
| 6,091,189 | A | * | 7/2000 | Shinjo et al. | 313/346 R |

* cited by examiner

*Primary Examiner*—Vip Patel
*Assistant Examiner*—Kevin Quarterman

(57) ABSTRACT

An electron tube provided with a semiconductor cathode for emitting electrons, which semiconductor cathode is arranged on a support, a source being arranged in the vicinity of the cathode, in particular, so as to face the free (Si) surface of the cathode, which source is capable of evolving, at the increased temperatures occurring during evacuation of the tube in the manufacturing process, a reducing agent such as $F_2$ or HF, which passivates the free (Si) surface of the cathode.

19 Claims, 2 Drawing Sheets

ELECTRON TUBE COMPRISING A SEMICONDUCTOR CATHODE

BACKGROUND OF THE INVENTION

The invention relates to an electron tube comprising a semiconductor cathode which is arranged on a support and which serves to emit electrons.

The electron tube can be used as a display tube or a camera tube but may alternatively be embodied so as to be suitable for electron lithographic applications or electron microscopy.

The electron tube can be used as a display tube or a camera tube but may alternatively be embodied so as to be suitable for electron lithographic applications or electron microscopy.

An electron tube of the type mentioned above is disclosed in U.S. Pat. No. 5,444,328. In a so-called semiconductor or "cold cathode", a pn-junction is operated in the reverse direction in such a manner that avalanche multiplication of charge carriers takes place. As a result, electrodes may acquire sufficient energy to exceed the work function voltage. The liberation of electrons is facilitated by the presence of a work function voltage-reducing material.

Cesium is a work function voltage-reducing material and oxygen is a work function voltage-increasing material. Also, Cs exhibits more desorption from an O-contaminated surface. Consequently, a clean cathode surface is important. SiO is etched away from the Si cathode surface by means of HF before depositing Cs. However, in the course of the manufacture of the electron tube, said tube must be evacuated.

During said evacuation of the tube, a temperature increase is necessary in order to be able to rapidly remove the adsorbed gas to a sufficient degree from the tube walls. Many gases evacuated in said process may again lead to oxidation of the silicon cathode surface at this increased temperature ($H_2O$, $CO_2$, . . . ).

SUMMARY OF THE INVENTION

The invention is based on the realization that if this is not taken into account or counteracted, the emission of the cathode during operation of the tube will be lower than expected.

Consequently, it is an object of the invention to provide an electron tube comprising a semiconductor cathode which is embodied in such a manner that undesirable oxidation of the exposed (Si) cathode surface during heating of the tube (as during evacuation) is reduced.

This object is achieved by an electron tube of the type described in the opening paragraph, whereby a source is arranged in the vicinity of the cathode, preferably so as to face the free (Si) surface of the cathode, which source is capable of evolving a reducing agent at an increased temperature. A reducing agent is to be taken to mean herein a gas molecule which is capable of passivating the silicon surface at an increased temperature (as in the case of evacuation), or even of removing an oxide compound formed at the silicon surface. This process is comparable to the process step carried out in the manufacture of the cathode, in which a mixture of HF water vapor and nitrogen gas is blown from the exterior into the tube and diffused over the cathode surface, thus causing the Si surface to be passivated by hydrogen and fluorine atoms. These atoms occupy the free bonding positions of an Si atom at the surface and thereby preclude oxidation by, for example, oxygen or water vapor. It will be obvious that during evacuation, such a passivating process (using a gas flow, so-called HF gas jets) is not possible. For this reason, the invention provides a source which is capable of evolving a reducing agent at increased temperatures. The temperature during evacuation ranges in general between 20 and 400° C., and in particular between 20 and 340° C.

Preferably, the reducing agent comprises fluorine or a fluorine compound.

A material capable of evolving fluorine or fluorine compounds (for example HF) at an increased temperature is, for example, macor™. Another material which can suitably be used is borosilicate glass or another glass capable of evolving fluorine at an increased temperature.

In accordance with an alternative embodiment, the source may be a matrix comprising a reducing agent, which agent can be readily evolved in a decelerated manner. As a result, molecules are liberated during the entire evacuation process. Said matrix may be, for example, a potassium bromide pellet. To produce this pellet, potassium bromide mixed with the reducing agent is compressed into a pellet.

The agent, whether or not comprised in a support, may alternatively be screen printed in a cell which is arranged near the cathode.

These and other aspects of the invention will be apparent from and elucidated with reference to the embodiments described hereinafter.

DETAILED DESCRIPTION OF THE INVENTOR

Figure 1:
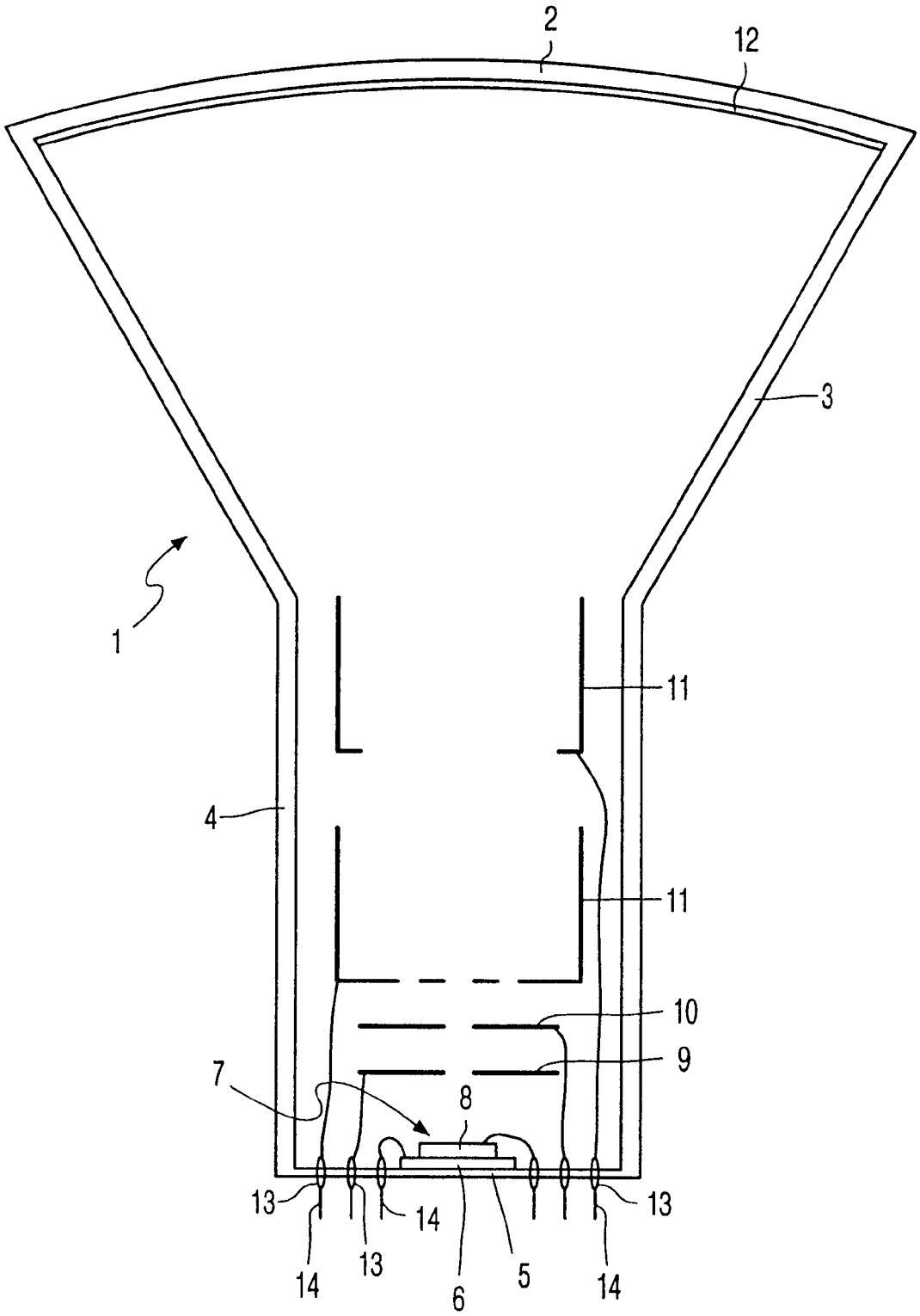
FIG. 1 shows an electron tube in accordance with the invention.

The invention will now be describe in greater detail with reference to the figure of the drawing.

FIG. 1 schematically shows an electron tube 1, in this case a cathode ray tube used for picture display. This electron tube 1 is composed of a display window 2, a cone 3 and an end portion 4 having an end wall 5. The inner surface is provided at the location of the end wall 5 with a support 6 on which, in this example, one or more semiconductor cathodes (pn-emitters) 7 having an emissive surface 8 are situated. The semiconductor cathode is of the avalanche breakdown type as described in U.S. Pat. No. 5,444,328.

In the end portion 4 are situated grid electrodes 9, 10 and further deflection electrodes 11. The cathode ray tube further includes a phosphor screen 12 at the location of the display window. Other elements forming part of such a cathode ray tube, such as shadow masks etc., are not shown in FIG. 1 for the sake of simplicity. For an electric connection of, inter alia, the cathode and the accelerating electrodes, the end wall 5 is provided with feedthroughs 13 via which the connection wires for these elements are electrically connected to connection pins 14.

A gas mixture of oxygen and ozone is blown in the tube in situ over a heated cathode surface, for example an Si surface before the tube is evacuated. This process step is carried out to remove hydrocarbons from the cathode surface. Immediately afterwards, a gas mixture of hydrogen fluoride, water vapor and nitrogen gas is blown over the cathode. This process step serves to remove the silicon oxide layer from the cathode surface. Both process steps are necessary to achieve a good cathode emission after the evacuation of the tube. When the silicon oxide is being removed by means of the HF gas etchant, the silicon surface is "passivated" by hydrogen and fluorine atoms. These atoms occupy the free bonding positions of a silicon atom at the surface, thereby precluding oxidation by, for example, oxygen or water vapor after the gas-etching operation. Passivation by means of hydrogen is preferred because it remains stable at a higher temperature than passivation using fluorine.

Figure 2:
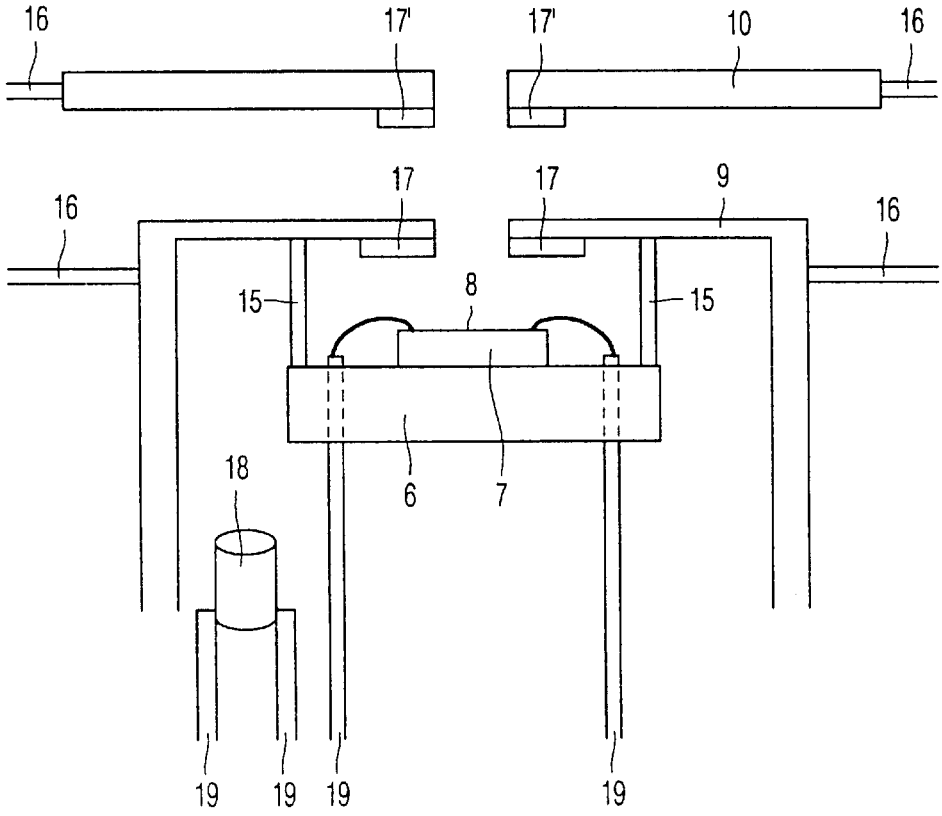
FIG. 2 schematically shows a part of FIG. 1.

FIG. 2 shows a possible construction of a part of an electron tube in accordance with the invention. Within the first grid 9, which is embodied so as to be a skirt, there is the support 6 supporting the semiconductor cathode 7. Said support 6 is connected to the grid 9 via connection elements 15. The grid 9, as well as a second grid 10, is secured in a larger assembly by means of clamping elements 16. The device further comprises a primary cesium source 18, in this example a cesium-chromate dispenser. Both the cesium-chromate dispenser and the cathode are in electrical contact with each other via connection wires 19. Other electrical contacts (for example of the grids 9, 10) are not shown in FIG. 2 for the sake of clarity.

Those of ordinary skill will recognize that the structure shown in FIG. 2 is part of what is commonly called an electron gun.

As discussed already in the opening paragraph, during the activation of the electron tube, cesium from the primary source 18 is evaporated in order to reduce the work function of the semiconductor cathode. During the service life, cesium is lost. This can be attributed to various causes.

For example, cesium is sensitive to the presence (in the environment where it is used) of oxidizing gases (such as water vapor, oxygen, $CO_2$). In addition, cesium has a high vapor pressure so that it evaporates readily. As a result of the dissipation of the cathode, its temperature increases, causing cesium to be lost. In addition, ESD (Electron Stimulated Desorption) occurs; the electrons emitted by the cathode induce desorption of cesium, particularly from slightly oxidized surfaces. This loss of cesium causes the electron-emission coefficient of the cathode to decrease in the course of its service life, causing said service life to be reduced substantially. An essential prerequisite for the use of Cs is that the Si surface on which the Cs is to be deposited is under control.

As described hereinabove, the invention provides a measure of counteracting oxidation of the Si surface during evacuating the tube. For this purpose, a source 17 which, at an increased temperature (during evacuation), evolves a reducing agent, in particular fluorine or a fluorine compound is arranged in the vicinity of the cathode. In an embodiment, the source 17 is a macor™ part, for example a strip or a ring, which is secured on the side of the first grid 9 situated opposite the free surface of the cathode 8. It is alternatively possible to use borosilicate glass in or for a part of the tube.

Macor™ is a machinable glass ceramic from Corning, which can be machined in the final state with standard metal-working tools. The parent glass is a heavily phase-separated white opal glass containing fluorine-rich droplets. On subsequent heating to 825° C., plate-like crystals of mica-phase fluoropholgopite $(KMg_3)AlSi_3O_{10}F_2)$ are formed. The result is a microstructure consisting of a highly interlocked array of two-dimensional mica crystals dispersed in a brittle glassy matrix.

The term reducing agent is to be taken to mean a gas molecule which is capable of re-passivating the silicon surface during evacuation at an increased temperature, or even of removing again an oxide compound formed at the silicon surface.

Tests carried out on the ceramic macor™ arranged in the HF gas flow so as to face the cathode showed that the cathode emission increased to a higher level after the arrangement of said macor™. This can be explained as follows: during the (temperature) evacuation process, fluorine compounds are released which passivate/reduce the cathode surface during said evacuation process.

The temperature during evacuation generally ranges between 20 and 340 degrees Celsius.

Figure 3:
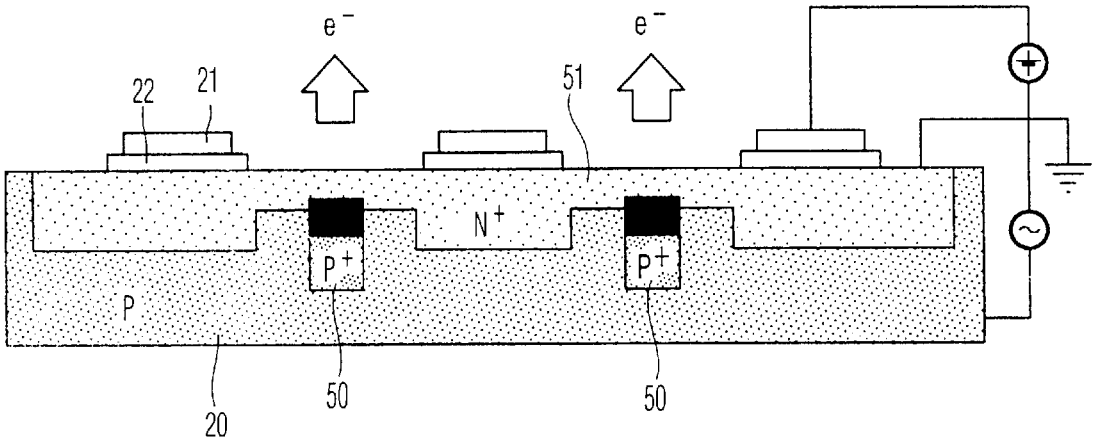
FIG. 3 is a schematic, cross-sectional view of a pn-emitter (avalanche cold cathode)

FIG. 3 is a schematic, cross-sectional view of the construction of a so-called avalanche cold cathode (AC-cathode). This cathode comprises an Si substrate 20 with a pn-junction. The "free" surface of the substrate (where emission of the e electrons takes place) is provided with a planar electron-optical system 21, which is separated from the substrate by an insulating layer 22. Said cathode further includes first means for generating an exciting voltage for the electron optical system, and second means for applying a video signal-related voltage.

Of course, the invention is not limited to the examples described herein, and within the scope of the invention many variations are possible to those skilled in the art. For example, silicon does not necessarily have to be used for the semiconductor body; alternatively use can be made of another semiconductor material such as silicon-carbide or an $A_3$-$B_5$ compound such as gallium arsenide. The p-type region 50 and the n-type region 51 can be contacted at a number of locations. This enables these regions to be subdivided into sub-regions, if necessary, which may be advantageous in connection with a high voltage on the connection conductors. It is also possible to use semiconductor cathodes having a different working principle, such as cathodes working in accordance with the negative electron affinity (NEA-cathodes) principle or field emitters. In addition, the cathodes do not always have to be accommodated in a vacuum space, they may alternatively be mounted, for example, in a space containing an inert protective gas. In this connection, an inert protective gas is to be taken to mean a gas which has no or only little effect on the efficiency-increasing effect of an electron bombardment, as described hereinabove.

What is claimed is:

1. An electron tube having an evacuated space, and comprising a support and a semiconductor cathode for emitting electrons arranged on the support in said space, wherein the electron tube further comprises means, responsive to increased temperatures, for evolving a reducing agent, said means for evolving comprising a source arranged in the vicinity of the cathode.

2. An electron tube as claimed in claim 1, wherein the semiconductor cathode has a free surface, and said source is arranged to face said free surface.

3. An electron tube as claimed in claim 1, wherein the source comprises a glass material.

4. An electron tube as claimed in claim 3, wherein the glass material comprises a borosilicate glass.

5. An electron tube as claimed in claim 3, wherein the cathode has a free Si surface.

6. An electron tube as claimed in claim 1, wherein the support and semiconductor cathode form part of an electron gun further comprising at least one grid having a surface facing said semiconductor cathode, and said source is arranged on said surface of the grid.

7. An electron tube as claimed in claim 6, wherein the source comprises a glass material.

8. An electron tube as claimed in claim 7, wherein the glass material comprises a borosilicate glass.

9. An electron tube as claimed in claim 7, wherein the cathode has a free Si surface.

10. An electron tube comprising a support and a semiconductor cathode for emitting electrons arranged on the support, wherein the electron tube further comprises a source of reducing agent arranged in the vicinity of the cathode, said source evolving a reducing agent at increased temperatures, said reducing agent being a member selected from the group consisting of fluorine and hydrogen fluoride.

11. An electron tube as claimed in claim 10, wherein the source is a ceramic consisting essentially of crystals of fluoropholgopite dispersed in a glassy matrix.

12. An electron tube as claimed in claim 10, wherein the semiconductor cathode has a free surface, and said source is arranged to face said free surface.

13. An electron tube as claimed in claim 10, wherein the source comprises a glass material.

14. An electron tube as claimed in claim 13, wherein the glass material comprises a borosilicate glass.

15. An electron tube as claimed in claim 13, wherein the cathode has a free Si surface.

16. An electron tube as claimed in claim 10, wherein the support and semiconductor cathode form part of an electron gun further comprising at least one grid having a surface facing said semiconductor cathode, and said source is arranged on said surface of the grid.

17. An electron tube as claimed in claim 16, wherein the source comprises a glass material.

18. An electron tube as claimed in claim 17, wherein the glass material comprises a borosilicate glass.

19. An electron tube as claimed in claim 17, wherein the cathode has a free Si surface.

* * * * *